US006820663B2

(12) United States Patent
Englert et al.

(10) Patent No.: US 6,820,663 B2
(45) Date of Patent: Nov. 23, 2004

(54) TOOL FOR MACHINING WORKPIECES OF WOOD, PLASTIC MATERIAL OR THE LIKE

(75) Inventors: Heinrich Englert, Lauda-Königshofen (DE); Albrecht Dawidziak, Grossrinderfeld (DE); Josef Ballweg, Külsheim (DE); Bernd Martin, Tauberbischofsheim (DE)

(73) Assignee: Michael Weinig Aktiengesellschaft, Tauberbischofsheim (DE)

( * ) Notice: Subject to any disclaimer, the term of this patent is extended or adjusted under 35 U.S.C. 154(b) by 133 days.

(21) Appl. No.: 10/143,167

(22) Filed: May 10, 2002

(65) Prior Publication Data

US 2002/0170629 A1 Nov. 21, 2002

(30) Foreign Application Priority Data

May 16, 2001 (DE) ..... 101 25 736

(51) Int. Cl.[7] ..... B27C 9/00; B27C 5/00

(52) U.S. Cl. ..... 144/218; 144/41; 144/134.1; 144/235

(58) Field of Search ..... 144/3.1, 36, 40, 144/41, 42, 218, 134.1, 233, 114.1

(56) References Cited

U.S. PATENT DOCUMENTS 2,635,657 A * 4/1953 Dietnich ..... 144/41
4,840,207 A * 6/1989 Lines ..... 144/41

* cited by examiner

*Primary Examiner*—W. Donald Bray
(74) *Attorney, Agent, or Firm*—Gudrun E. Huckett

(57) ABSTRACT

A tool for machining workpieces of wood, plastic material, or the like has at least one plane head provided with cutting knives and having a first end and a second end. A first surface milling cutter is arranged on the first end of the plane head. At least one second surface milling cutter is connected to the plane head and is adjustable relative to the first surface milling cutter. The plane head has at least one axial guide for the second surface milling cutter. The axial guide is a fitting groove provided in the mantle surface of the plane head. The second surface milling cutter has a feather key engaging the fitting groove.

18 Claims, 2 Drawing Sheets

TOOL FOR MACHINING WORKPIECES OF WOOD, PLASTIC MATERIAL OR THE LIKE

BACKGROUND OF THE INVENTION

1. Field of the Invention

The invention relates to a tool for machining workpieces of wood, plastic material, or the like, the tool comprising a surface milling cutter and at least one plane head which supports cutting knives.

2. Description of the Related Art

In such a known tool (European patent application 0 559 577 A1) the surface milling cutter and the plane head with the cutting elements are connected to a common machine spindle. The workpiece which is moving through the corresponding machine is machined by the surface milling cutter on one lateral surface and by means of the cutting knives of the plane head on its bottom side. Since the workpieces are to be machined on all four sides when passing through a woodworking machine, the machine is provided with additional spindles on which a further surface milling cutter for machining the other lateral surface of the workpiece as well as an additional tool for machining the top side of the workpiece are provided. The machine accordingly is of a complex configuration and correspondingly expensive. Moreover, there are significant problems in regard to machining the two lateral surfaces of the workpiece, extending in the transport direction of the workpiece through the machine, precisely parallel to one another because the corresponding tools are seated on different spindles and must be adjusted independently of one another.

SUMMARY OF THE INVENTION

It is an object of the present invention to configure the tool of the aforementioned kind such that the workpiece can be machined with great precision.

In accordance with the present invention, this is achieved in that the tool has at least one additional surface milling cutter which is adjustable on the plane head relative to the other surface milling cutter.

By means of the tool according to the invention the workpiece is machined simultaneously on three sides. By means of the two surface milling cutters the lateral surfaces, extending in the transport direction of the workpiece through the machine, are machined while by means of the cutting knives of the plane head one outer side of the workpiece is machined. Accordingly, as the workpiece passes through the corresponding machine, it is only necessary to machine the other outer side of the workpiece. Since the two surface milling cutters are seated on the same spindle, the lateral surfaces of the workpiece can be machined absolutely straight and, in particular, absolutely parallel to one another which is a mandatory requirement for a subsequent adhesive bonding of the workpiece. Since the lateral surfaces of the workpiece are front-milled by the two surface milling cutters, they have an optimal surface area for the subsequent adhesive bonding process. As a result of the configuration according to the invention, the machine in which the tool according to the invention is employed requires only a minimal number of spindles so that the machine is of a constructively simple configuration and can be produced cost-efficiently without this reducing the machining quality and the machining precision. In the context of the present invention, the term plane head refers to a tool whose cutting knives can have straight or profiled cutting edges.

DESCRIPTION OF THE PREFERRED EMBODIMENTS

Figure 1:
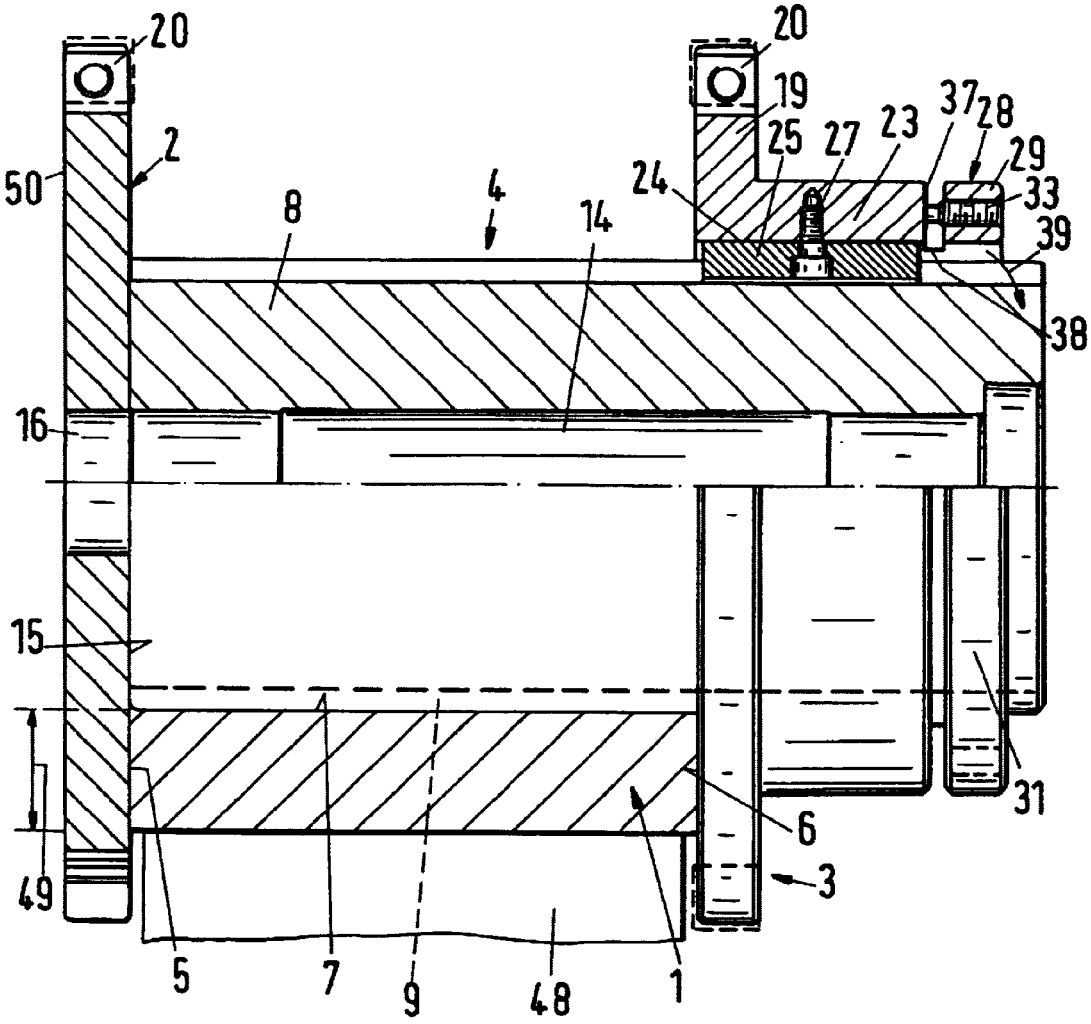
FIG. 1 shows partially an axial section and partially an elevated view of the tool according to the invention.

The tool serves primarily for machining workpieces of wood, plastic material or the like and is seated on a spindle (not illustrated) of a corresponding machine, preferably a molding or shaping machine. By means of a single tool machining of a workpiece 1 is possible on three sides of the workpiece 1 while the workpiece is transported through the machine as is known in the art. The tool has two surface milling cutters 2, 3 between which the plane head 4 is positioned. By means of the surface milling cutters 2, 3, the oppositely positioned sides 5, 6 of the workpiece 1 are machined. The side surfaces 5, 6 are positioned in the transport direction of the tool 1 through the machine. By means of the plane head 4 the top side 7 of the workpiece 1 is machined while passing through the machine. The plane head 4 can also be in the form of a profiled knife head which supports profiled knives so that the top side 7 of the workpiece 1 is provided with a matching profiling.

The plane head 4 has a base member 8 which supports cutting knives 9 on its circumference in a way known in the art. The knives 9 are clamped in circumferential grooves 10 of the base member 8 by means of pressure elements 11. These pressure elements 11 are actuated by clamping screws 12 which are positioned in a sunk arrangement. By tightening the clamping screws 12, the pressure elements 11 are forced in the direction of the oppositely positioned sidewall 13 of the respective groove 10 so that the cutting knives 9 are clamped by the pressure elements 11 against the groove sidewalls 13. The pressure elements 11 can extend across the entire length of the grooves 10. However, it is also possible to provide for each cutting knife 9 adjacently positioned pressure elements 11.

The base member 8 has an axial opening 14 which penetrates the base member 8 in the longitudinal direction. The base member 8 can be slipped onto the machine spindle (not illustrated) with this opening 14.

The surface milling cutter 2 is fastened, preferably, by a screw connection, on one end face 15 of the base member 8. However, the surface milling cutter 2 can also be an independent unit slipped onto the spindle. The surface milling cutter 2 has a greater working diameter than the plane head 4 and is provided with a central opening 16 through which a part of the spindle projects.

Figure 2:
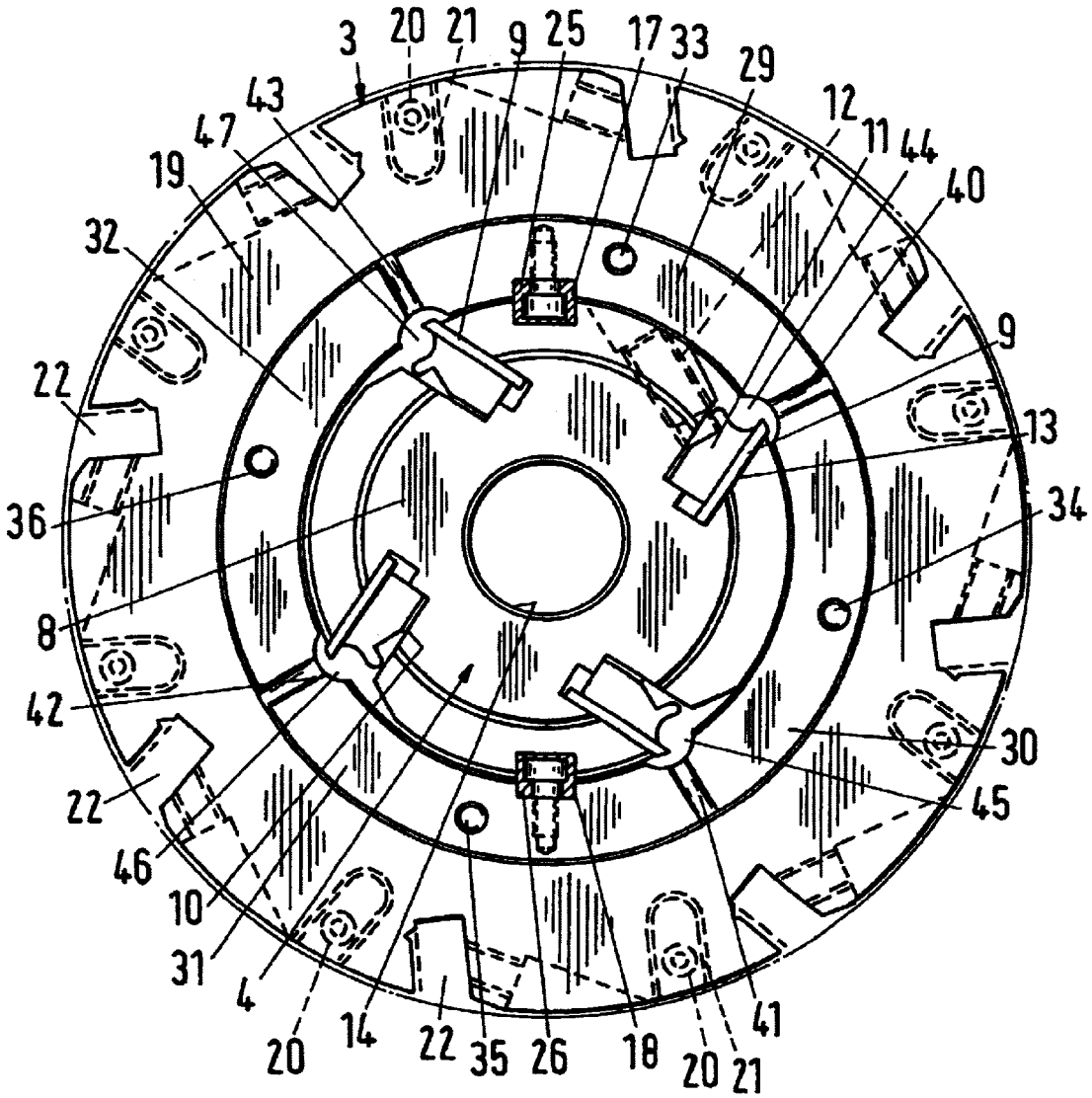
FIG. 2 is an end view of the tool according to the invention.

As illustrated in FIG. 2, the base member 8 is provided with two diametrically opposed fitting grooves 17 and 18 extending in the axial direction. The surface milling cutter 3 can be mounted and secured against rotation on the base member 8 of the plane head 4 by means of the fitting grooves 17, 18. The two fitting grooves 17, 18 extend across the axial length of the base member 8 and are identical.

The surface milling cutter 3 has a disk-shaped base member 19 which supports face cutters 20 about its circumference. They are fastened in a way known in the art in circumferentially arranged receptacles 21 of the base member 19. Instead of the face cutters 20 it is also possible to provide carvers. Also, grooves 22 are distributed on the circumference of the base member 19, as can be seen in FIG. 2, in which cutters can be arranged circumferentially.

The surface milling cutter 2 is also provided with face cutters 20 and grooves for receiving circumferential cutters about its circumference.

The disk-shaped base member 19 projects from a sleeve-shaped bearing part 23 radially outwardly. Preferably, the base member 19 and the bearing part 23 form a unitary or monolithic part. The base member 19 is provided at one end of the bearing part 23 which is provided with diametrically opposed, axially extending grooves 24 for receiving the feather keys 25, 26. By means of these feather keys 25, 26 the surface milling cutter 3 is positioned precisely on the base member 8. Each feather key 25, 26 is advantageously detachably or releasably connected by means of a screw 27 on the inner side of the bearing member 23. The feather keys 25, 26 cooperating with the fitting grooves 17,18 ensure a proper fixed connection between the plane head 4 and the surface milling cutter 3 for common rotation. Moreover, the surface milling cutter 3 can be moved on the base member 8 in the axial direction for adaptation to workpieces 1 of different widths.

A clamping device 28 is provided for the attachment of the surface milling cutter 3 in its respective axial position on the base member 8. It has four clamping segments 29 to 32 (FIG. 2) which are of a part-circular shape and extend about the circumference of the base member 8. Each clamping segment 29 to 32 has at half its length a threaded bore for a clamping screw 33 to 36. The axially positioned clamping screws 33 to 36 are supported with their free end on an end face 37 of the bearing part 23 of the surface milling cutter 3 (FIG. 1). The clamping segments 29 to 32 have axial spacing from the end face 37 of the bearing part 23 and are connected, respectively, by means of a narrow stay 38 resting on the mantle surface of the base body 8 with the bearing part 23; preferably, they are formed as a unitary or monolithic part thereof. When the clamping screws 33 to 36 are tightened, they are supported on the end face 37 of the bearing part 23. In this way, a clamping force or tilting moment in the direction of arrow 39 in FIG. 1 is exerted on the clamping segments 29 to 32 which causes the clamping segments 29 to 32, and thus the surface milling cutter 3, to be secured absolutely tightly on the base member 8. The clamping segments 29 to 32 are provided on the side of the surface milling cutter 3 facing away from the surface milling cutter 2.

When the surface milling cutter 3 is to be axially moved on the base member 8 for adjustment to the workpiece width, the clamping screws 33 to 36 are unscrewed so that the clamping force 39 is reduced to such an extent that the surface milling cutter 3 with the clamping device 28 can be moved into the desired axial position on the base member 8. This adjustment can be realized by means of a measuring scale or graduation provided on the base member 8 or by means of a workpiece sample.

The clamping segments 29 to 32 are separated from one another by radially extending slots 40 to 43 (FIG. 2). The cutting knives 9 of the plane head 4 are advantageously positioned at the level of these slots 40 to 43. Moreover, the surface milling cutter 3 is provided at its inner bore with recesses 44 to 47 provided for the cutting knives 9 of the plane head 4 and extending across the axial length.

In order for the two surface milling cutters 2, 3 to be able to machine the workpiece 1 properly on the longitudinal sides 5, 6 extending in the transport direction, the machine table, on which the workpieces 1 are resting during their transport through the machine, is formed as a table stay 48 in the area of this spindle. This stay is smaller than the spacing of the surface milling cutters 2, 3 or the width of the workpiece 1. This ensures that the surface milling cutters 2, 3 have a sufficient spacing from the machine table stay 48.

The maximum workpiece height 49 (FIG. 1) depends on the diameter of the surface milling cutter 2, 3 as well as of the plane head 4.

The tool is pushed onto the machine spindle such that the surface milling cutter 2 with its lateral surface 50 facing away from the surface milling cutter 3 rests against a stop of the spindle. On the opposite side, the tool is then secured axially on the machine spindle in a way known in the art. In the embodiment, the tool is positioned on the upper spindle relative to the transport direction of the workpiece 1 through the machine so that the right side surface 5 is machined with the surface milling cutter 2 and the left side surface 6 of the workpiece 1 is machined with the surface milling cutter 3 (when viewing the workpiece 1 in the transport direction through the machine). By means of the plane head 4 the top side 7 of the workpiece 1 is machined.

Since the tool is provided with the two surface milling cutters 2, 3 and the plane head 4, only a single machine spindle is required for such a tool. The lateral surfaces 5, 6 of the workpiece 1 are machined absolutely straight and primarily also parallel to one another, which is a mandatory requirement for the later adhesive bonding of the workpieces. When using the tool according to the invention, the machine required for machining the workpieces 1 needs only two spindles in the simplest case. On the first spindle a plane head is seated with which the bottom side of the workpiece 1 is machined. On the second spindle, the described tool according to the invention is positioned with which the remaining three sides of the workpiece 1 are machined.

However, the machine advantageously has three spindles. The first spindle of the machine is a horizontal surface planing spindle arranged underneath the transport path for the workpieces, as is known in the art, with which preferably at least one guide stay is milled into the workpiece 1. The machine table and the table stay 48 have a matching guide groove. In the transport direction downstream of this lower surface planing spindle, the machine is provided with a horizontal spindle with the described tool with which the workpiece 1 is simultaneously machined on three sides. This machine spindle is arranged in the area above the workpieces 1 when passing through the machine. At a spacing behind this upper spindle, the machine is provided with an additional lower horizontal spindle on which a milling cutter is seated which removes the guide stay which has been produced by the first lower surface planing spindle.

By means of the described tool very high-quality workpieces can be produced wherein the machine used for this purpose is of a simple configuration and can be manufactured inexpensively.

The plane head 4 has an outer diameter which is machined for proper fit. For this purpose, the cutting knives 9 are clamped with operating forces and arranged such in the base member 8 of the plane head 4 that they do not project radially past the mantle surface of the base member 8. A plane head 4 which is ground cylindrically in this way has excellent roundness and fitting precision under the conditions of use. The bore of the surface milling cutter 3 has a matching high fitting precision. This provides an excellent run-out of the milling cutter 3. Moreover, the surface milling cutter 3 can be easily moved on the plane head for adjustment relative to the surface milling cutter 2. After the cylindrical grinding process the cutting knives 9 are adjusted with regard to their working position and, in a way known in the art, are moved onto a common described circle of their cutting edges.

While specific embodiments of the invention have been shown and described in detail to illustrate the inventive principles, it will be understood that the invention may be embodied otherwise without departing from such principles.

What is claimed is:

1. A tool for machining workpieces of wood or plastic material, comprising:

at least one plane head provided with cutting knives and having a first end and a second end;

a first surface milling cutter arranged on the first end of the at least one plane head; and at least one second surface milling cutter connected to the at least one plane head and configured to be adjustable relative to the first surface milling cutter.

2. The tool according to claim 1, wherein the at least one plane head has at least one axial guide for the at least one second surface milling cutter.

3. The tool according to claim 2, wherein the at least one axial guide is a fitting groove provided in a mantle surface of the at least one plane head.

4. The tool according to claim 3, wherein the at least one second surface milling cutter has a feather key engaging the fitting groove.

5. The tool according to claim 1, further comprising a clamping device configured to clamp the at least one second surface milling cutter on the plane head.

6. The tool according to claim 5, wherein the clamping device has at least two clamping segments.

7. The tool according to claim 6, wherein the clamping device comprises at least one clamping screw acting on the at least two clamping segments for moving the at least two clamping segments from a clamping position into a release position.

8. The tool according to claim 5, wherein the clamping device is connected to the at least one second surface milling cutter.

9. The tool according to claim 8, wherein the clamping device and the at least one second surface milling cutter form a monolithic part.

10. The tool according to claim 6, wherein the at least one second surface milling cutter has a sleeve-shaped bearing part supporting the at least one second milling cutter on the plane head.

11. The tool according to claim 10, wherein the at least two clamping segments are connected by at least one stay with the sleeve-shaped bearing part.

12. The tool according to claim 7, wherein the at least one clamping screw is supported on an end face of the sleeve-shaped bearing part.

13. The tool according to claim 7, wherein the at least one clamping screw exerts a tilting moment on the at least two clamping segments directed against the at least one plane head in a clamping position of the clamping device.

14. The tool according to claim 6, wherein the at least two clamping segments are separated from one another by a slot, respectively.

15. The tool according to claim 14, wherein the cutting knives of the at least one plane head are positioned at the level of the slot between the clamping segments, respectively.

16. The tool according to claim 6, wherein the at least one second surface milling cutter has an inner bore having a recess at the level of the cutting knives, respectively, wherein the recess extends across an axial length of the at least one second surface milling cutter.

17. The tool according to claim 1, wherein the cutting knives have straight cutting edges.

18. The tool according to claim 1, wherein the cutting knives have profiled cutting edges.

* * * * *